US009939223B1

(12) United States Patent
Heizer et al.

(10) Patent No.: US 9,939,223 B1
(45) Date of Patent: Apr. 10, 2018

(54) PISTOL WITH SHORT BARREL AND DEEP GROOVE RIFLING

(71) Applicant: Heizer Defense, LLC, Pevely, MO (US)

(72) Inventors: Charles K. Heizer, St. Louis, MO (US); Thomas C. Heizer, St. Louis, MO (US); Hedy H. Gahn, St. Louis, MO (US)

(73) Assignee: Heizer Defense, LLC, Pevely, MO (US)

( * ) Notice: Subject to any disclaimer, the term of this patent is extended or adjusted under 35 U.S.C. 154(b) by 0 days.

(21) Appl. No.: 15/099,787

(22) Filed: Apr. 15, 2016

Related U.S. Application Data

(63) Continuation-in-part of application No. 14/949,873, filed on Nov. 23, 2015, now Pat. No. 9,335,110.

(60) Provisional application No. 62/147,687, filed on Apr. 15, 2015.

(51) Int. Cl.

| | |
|---|---|
| ***F41A 19/00*** | (2006.01) |
| ***F41A 21/18*** | (2006.01) |
| ***F41C 3/00*** | (2006.01) |
| ***F41A 19/10*** | (2006.01) |

(52) U.S. Cl.
CPC ..... *F41A 21/18* (2013.01); *F41A 19/10* (2013.01); *F41C 3/00* (2013.01)

(58) Field of Classification Search
CPC ..... F41A 21/18
See application file for complete search history.

(56) References Cited

U.S. PATENT DOCUMENTS

| | | | | |
|---|---|---|---|---|
| 1,335,444 | A * | 3/1920 | Lashley | F41A 21/18 42/78 |
| 2,844,902 | A * | 7/1958 | Gaylord, Jr. | F41C 9/02 42/1.09 |
| 3,100,358 | A * | 8/1963 | Robinson, Jr. | F41A 21/18 42/78 |
| 3,525,172 | A | 8/1970 | Marshall | |
| 3,562,945 | A * | 2/1971 | Mikola | F41A 21/18 42/78 |
| 4,308,681 | A * | 1/1982 | Gorman | F41A 21/18 42/78 |
| 4,527,348 | A | 7/1985 | Brennan | |

(Continued)

FOREIGN PATENT DOCUMENTS

| | | | | |
|---|---|---|---|---|
| DE | 2411421 | A1 * | 9/1975 | F41A 21/18 |

*Primary Examiner* — Gabriel Klein
(74) *Attorney, Agent, or Firm* — Creativenture Law, LLC; Dennis JM Donahue, III

(57) ABSTRACT

A barrel has a barrel body that extends a barrel length and a bore extending through the barrel body. The bore has a cartridge chamber section and a rifled section with a bore diameter. A cartridge shell fits within the cartridge chamber section and the projectile extends from the cartridge chamber section into the rifled section. The cartridge shell with the projectile has a shell length within the bore, the barrel length is less than twice the shell length. The rifled section has rifling grooves between rifling lands, and each of the rifling lands has a land width. The groove diameter is greater than the land diameter by an amount that is more than one half of the land width. The barrel body has an extractor assembly with an arm retractably extending from a cavity. The arm can rotate in the cavity when extended and does not rotate when retracted.

19 Claims, 5 Drawing Sheets

(56) References Cited

U.S. PATENT DOCUMENTS

| | | | | | |
|---|---|---|---|---|---|
| 4,590,698 | A | | 5/1986 | Finn | |
| 5,844,162 | A | * | 12/1998 | Renner | F41A 21/18 42/51 |
| 7,739,821 | B1 | * | 6/2010 | Hamme | F41A 3/06 42/2 |
| 9,500,424 | B1 | * | 11/2016 | Lodewyks | F41A 15/06 |
| 2010/0000137 | A1 | * | 1/2010 | Carmel | F41A 19/10 42/1.05 |

* cited by examiner

PISTOL WITH SHORT BARREL AND DEEP GROOVE RIFLING

CROSS-REFERENCE TO RELATED APPLICATIONS

This application is a continuation-in-part of U.S. patent application Ser. No. 14/949,873 filed on Nov. 23, 2015 and also claims priority to U.S. Provisional Patent Application No. 62/147,687 filed on Apr. 15, 2015, both of which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a barrel for a firearm, and more particularly to a short barrel relative to the cartridge being fired in which the barrel rifling has deep grooves.

Related Art

Pistols that have rifling grooves on the interior surface of the gun barrels are well known. It is also known to have a barrel which has a smaller internal diameter proximate to the cartridge chamber within the barrel and has a larger internal diameter at the muzzle with a transition region between the smaller and larger diameters. Additionally, it is known to increase the depth of rifling grooves in the smaller diameter section of the barrel to permit a portion of the expanding gas from the detonated cartridge to flow through the grooves ahead of the projectile to relieve pressure within the barrel as the projectile moves from its firing ready position to the end of the barrel. Similarly, it is known to incorporate both rifling grooves and deeper pressure relief grooves into the barrel's interior cylindrical wall. Examples of these known barrels are disclosed in U.S. Pat. No. 3,525,172, U.S. Pat. No. 4,527,348, and U.S. Pat. No. 4,590,698 which are incorporated by reference.

Snub-nosed revolvers are known to have extremely short barrels to aid in their concealment. Revolvers do not require any increased rifling groove depth because the cartridge chambers are separate from the barrel so excess pressure is relieved in the open space between the chambers and the barrel. Even for revolvers which carry a large caliber round, there is no need to increase the rifling groove depth.

There are pistols which fire large caliber ammunition using long barrels, such as the Kel Tec PLR 16 223. However, these long barrel pistols are not readily concealable. To aid in the concealment of a pistol that carries a large caliber round in a chamber formed in the barrel, it would be advantageous to shorten the length of the barrel similar to a snub-nosed revolver.

SUMMARY OF THE INVENTION

In one aspect of the present invention, the length of a pistol barrel between a cartridge chamber and a muzzle is less than the length of the unspent cartridge.

In another aspect of the present invention, the overall length of a pistol barrel is less than twice the length of an unspent cartridge.

In another aspect of the present invention, the rifled portion of the pistol barrel has grooves which are deeper than a standard groove depth for the cartridge that is fitted to the barrel's cartridge chamber.

The aspects of the present invention as summarized above can be used together or may be used apart from each other in various firearms.

Further areas of applicability of the present invention will become apparent from the detailed description provided hereinafter. It should be understood that the detailed description and specific examples, while indicating the preferred embodiment of the invention, are intended for purposes of illustration only and do not limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
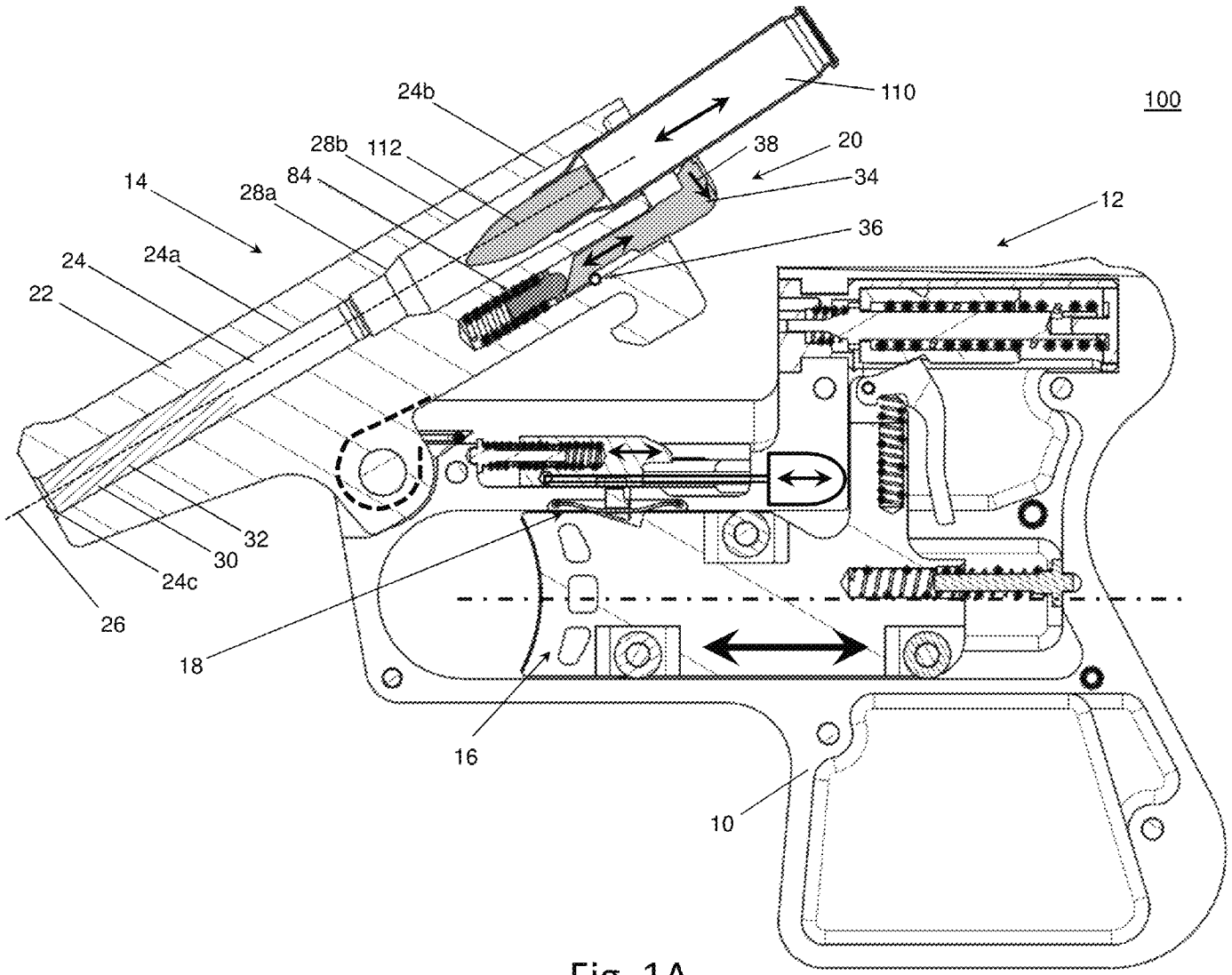
FIGS. 1A and 1B are cross-sectional views of a firearm respectively showing a barrel according to the present invention in an open position and a closed position and a spent cartridge in an open position, both views showing an unspent cartridge.
Figure 1B:
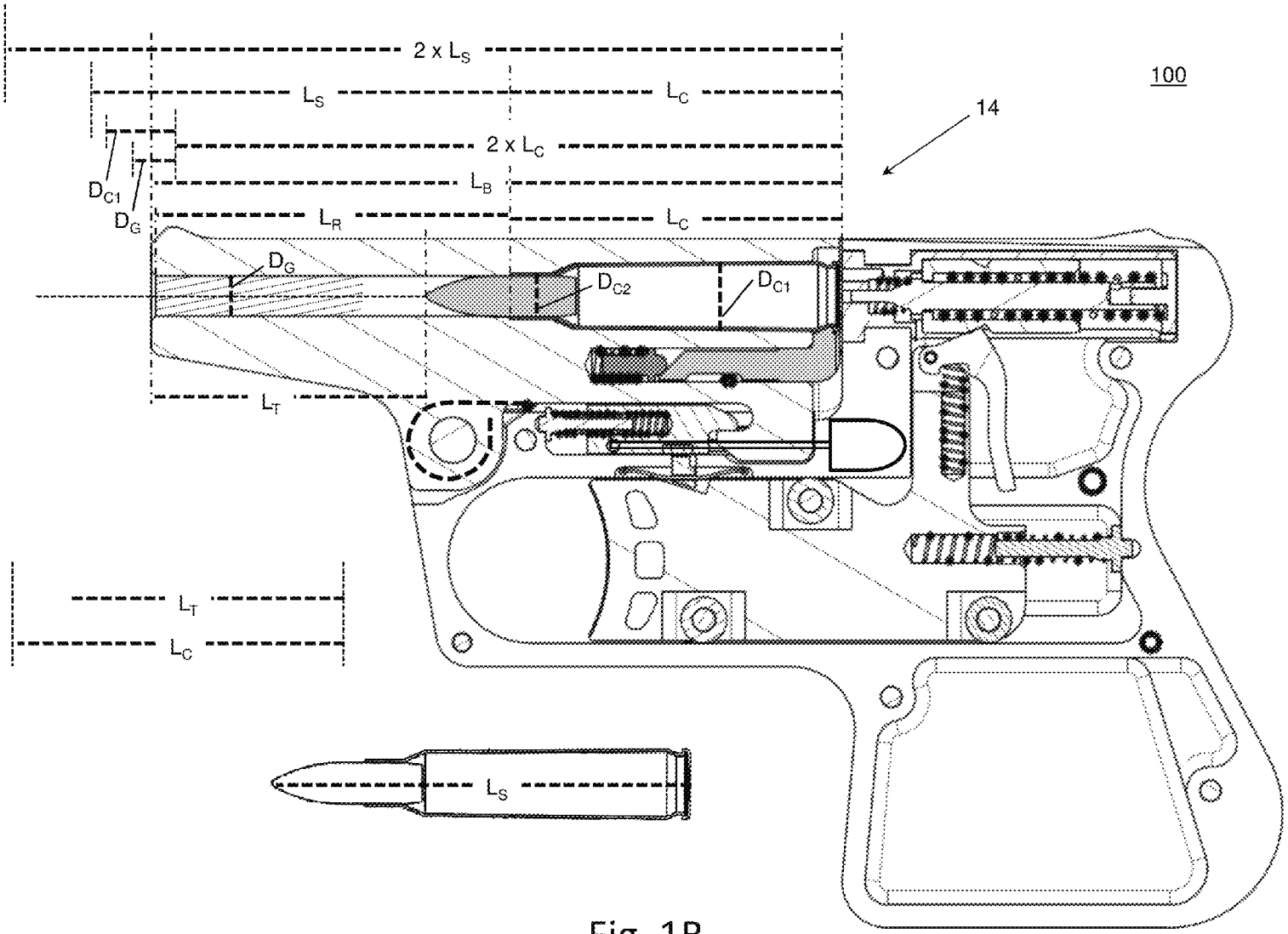
Figure 1C:
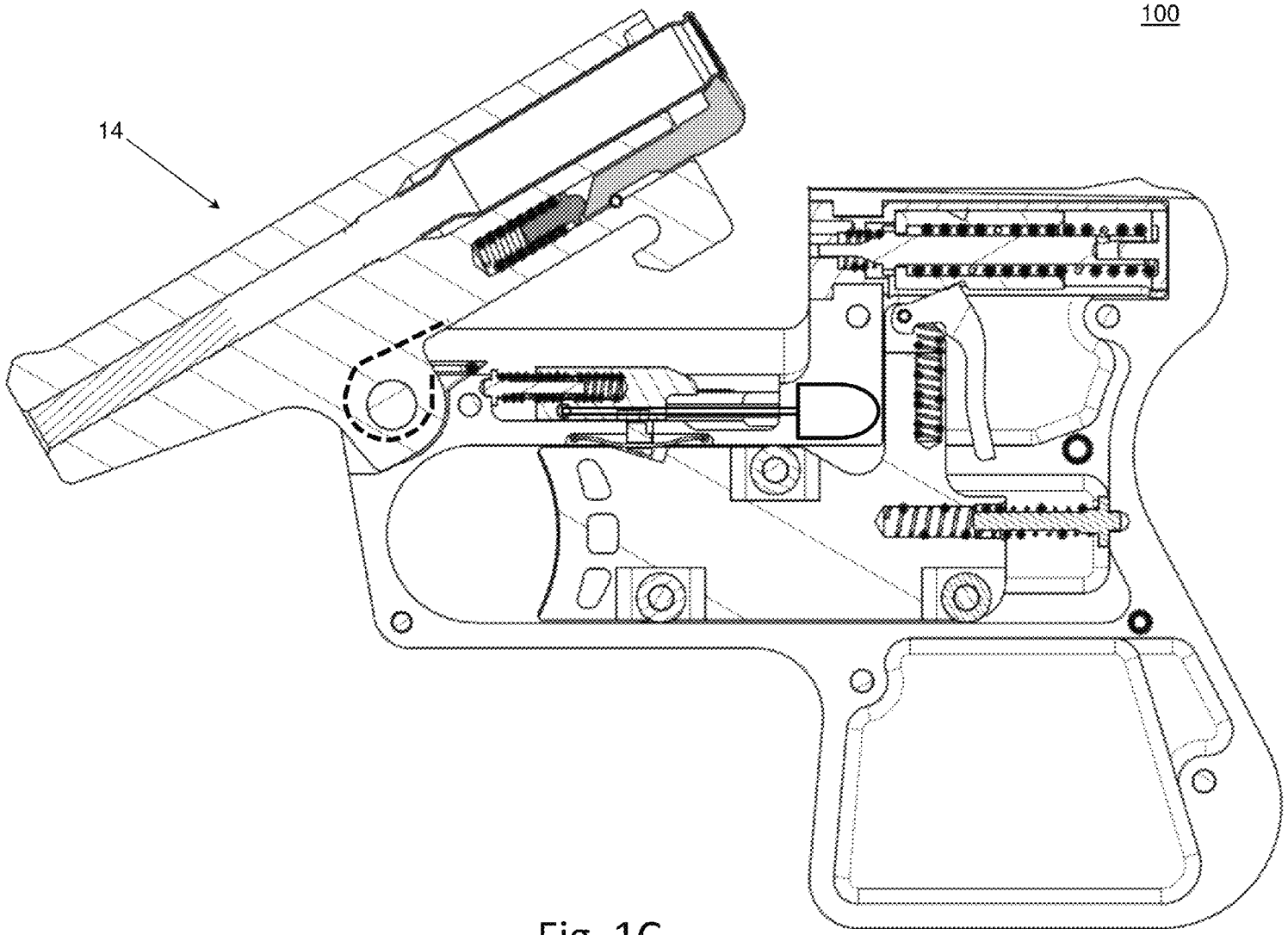
FIG. 1C is a cross-sectional view of the firearm illustrated FIGS. 1A and 1B showing the barrel in an open position with a spent cartridge.

Generally, as shown in FIGS. 1A-1C, the firearm 100 has a frame 10, a firing assembly 12, a barrel assembly 14, and a trigger assembly 16. The firearm preferably includes a barrel latch safety locking mechanism 18. The barrel assembly 14 is rated to fire a projectile 112 from a cartridge shell 110. The barrel assembly has a body 22, an interior bore 24 and an extractor assembly 20. The body extends for a barrel length ($L_B$) between a proximal end and a distal end, and the interior bore extends through the barrel body from the proximal end to the distal end. The interior bore has a bore longitudinal axis 26 that is aligned with the body longitudinal axis.

The interior bore has a rifled section 24*a* and a cartridge chamber section 24*b*. The cartridge shell fits in the cartridge chamber section and has a chamber length ($L_C$) extending from the proximal end to a chamber end location that is between the proximal end and the distal end. The cartridge chamber section has a wide-body diameter ($D_{C1}$) corresponding with the body of the shell and a narrow diameter ($D_{C2}$) corresponding with the neck of the shell. The chamber has a steep taper 28*a* between the wide-body diameter and the narrow diameter which corresponds with the shoulder of the shell. The chamber's wide-body diameter has a minimum diameter proximate to the steep taper and gradually widens with a shallow taper 28*b* to a maximum diameter proximate to the proximal end of the barrel where the shell is inserted. The distal end of the interior bore preferably includes a smooth bore section 24*c* and has a greater diameter ($D_{SB}$) than the groove diameter ($D_G$) of the rifled section. It will also be appreciated that rifling grooves 30 and corresponding rifling lands 32 may be provided throughout the entire rifled section or may only be provided in a portion of the rifled section.

Figure 2B:
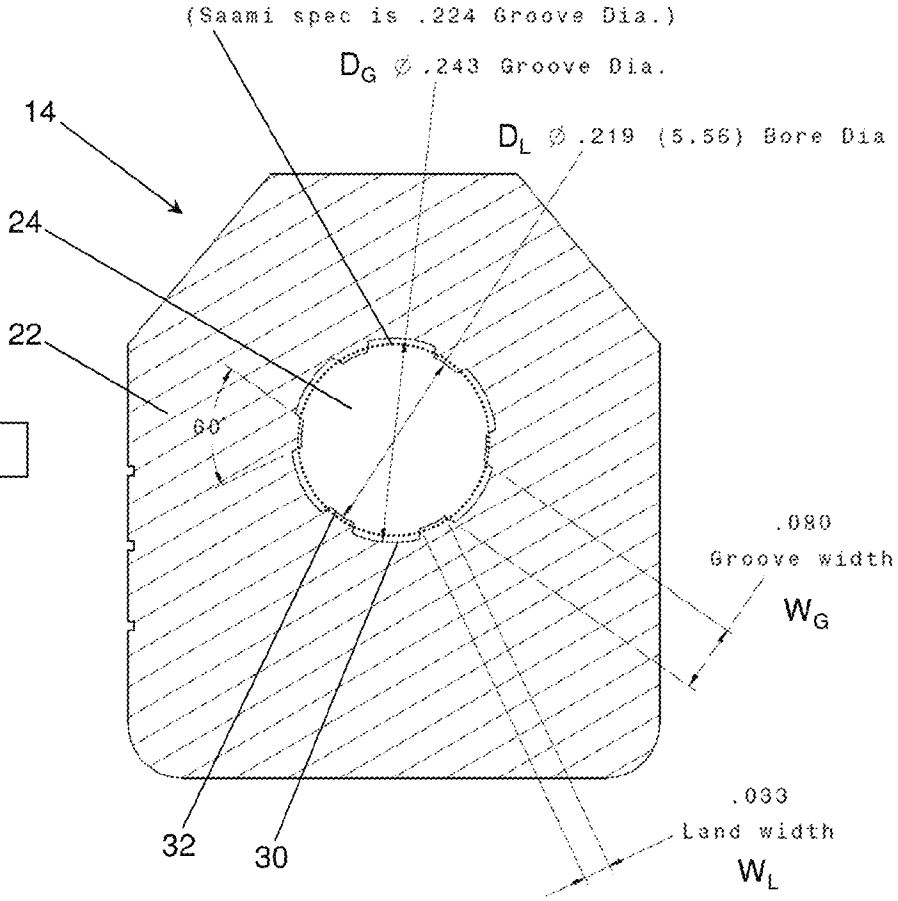
FIG. 2B is a cross-sectional view of the barrel shown in FIG. 2A taken along the section A-A.
Figure 2A:
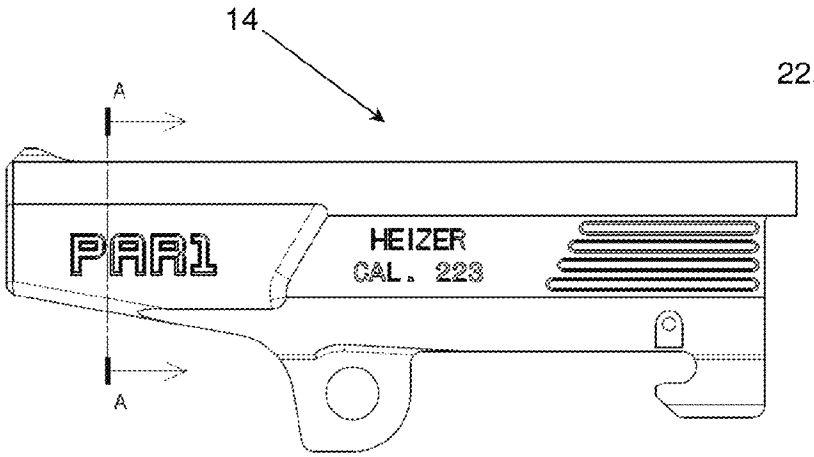
FIG. 2A is a side view of the barrel.

The projectile extends from the chamber end location to a projectile end location in the interior bore's rifled section. A projectile travel length ($L_T$) of the interior bore extends from the projectile end location to a muzzle at the distal end. The rifling grooves 30 and rifling lands 32 helically extend through interior bore's rifled section. As particularly shown in FIG. 2B, the bore has a bore land diameter ($D_L$) between opposing lands and a groove diameter ($D_G$) between opposing grooves 30. Each one of the rifling lands and rifling grooves has a land width and a groove width, respectively. In the preferred embodiment, the land width (0.033") is less than one half the groove width (0.080"), and the groove diameter (0.243") is greater than the land diameter (0.219") by an amount that is more than one half of the land width. The land diameter is a standard rated diameter for the projectile, smaller than the narrow diameter of the chamber, whereas the groove diameter is greater than the standard rated depth (0.224") for the projectile. The deeper groove diameter allows a portion of the expanding gas from the detonated shell to bleed through the deep grooves past the accelerating projectile within the interior bore and provide pressure relief. Increasing the groove width between the lands increases the volume of the space for the bleed gas to escape past the projectile. It will be appreciated that the greater groove depth for the preferred embodiment is more than three (3) times as deep as the standard rated groove depth (0.019">3*0.005").

The barrel is designed to fit a standard assault rifle shell within the chamber, such as a Remington 223 shell. However, the barrel is significantly shorter than a standard barrel for a rifle and much shorter than previously known pistols which shoot comparable shells. According to the present invention, the projectile travel length ($L_T$) is less than the chamber length ($L_C$). As particularly shown in FIG. 1B, the barrel length is so short that twice the length of the chamber comes to within one bore diameter of the barrel's muzzle ($L_B+D<2*L_C<L_B+D$, where $D=D_G$ or Dc); accordingly, the barrel length is approximately equal to double the chamber length ($L_B\approx 2*L_C\pm D$, where $D=D_G$ or Dc). The projectile travel length of the interior bore is actually shorter than the length of the unspent cartridge; accordingly, the barrel length is shorter than the combined length of the shell ($L_S$) and the chamber ($L_B<L_S+L_C$). The barrel length is also shorter than the length of two shells ($L_B<2*L_S$).

Figure 3:
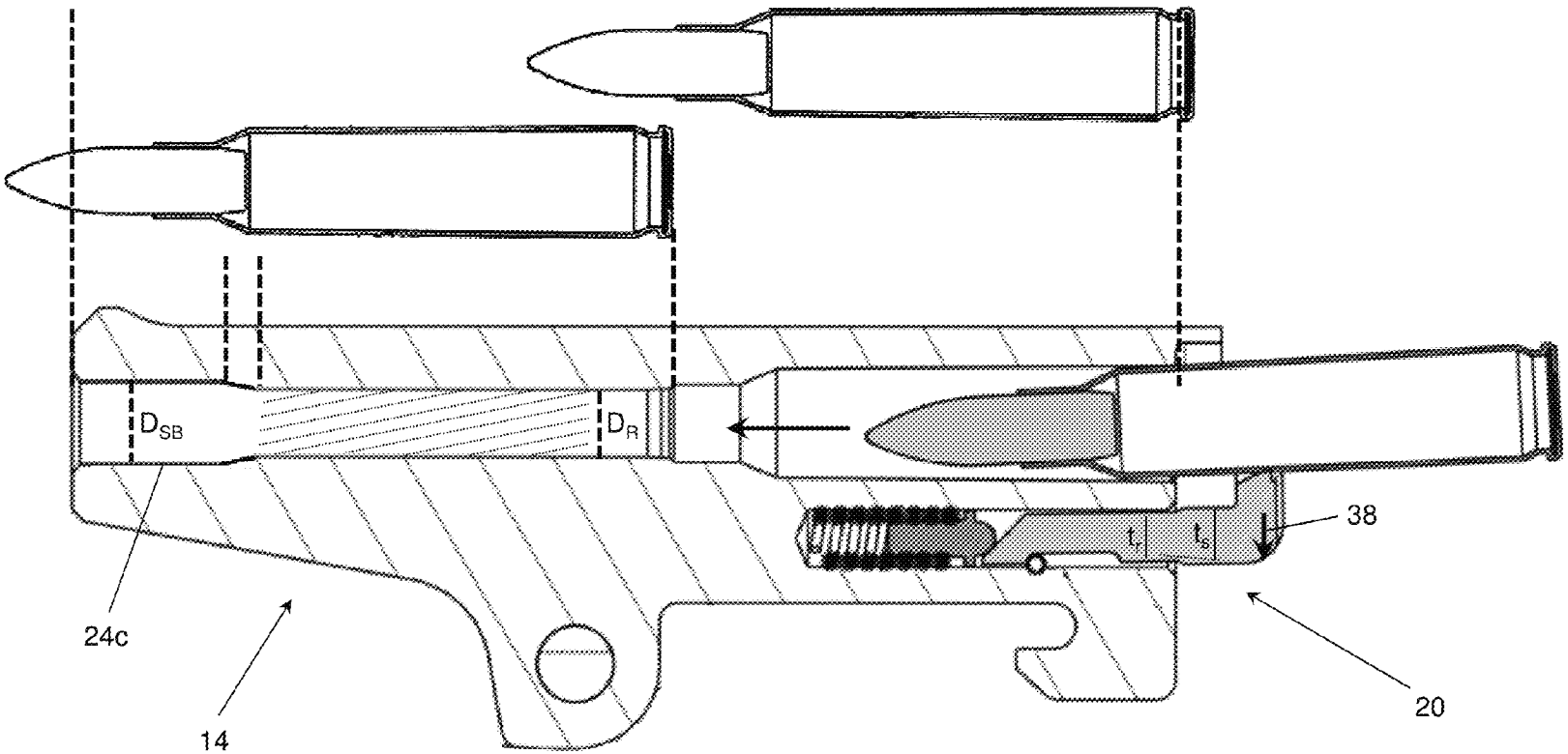
FIG. 3 is a cross-sectional view of an alternative barrel.

As shown in FIGS. 1 and 3, an innovative extractor assembly 20 for rimless shells that are fitted into the firing chambers of breech loading firearms can also be incorporated into the barrel design. Aspects of the present invention can be used for non-tapered rimless shells, and the inventive aspects are most advantageous when used with tapered rimless shells. The rimless extractor assembly has an extractor arm 34 with a proximal end, a longitudinally extending elongated section and a laterally extending projection at a distal end. The extractor arm fits within a cavity 36 that extends longitudinally into the barrel assembly between the barrel's firing chamber and the hook at the bottom of the barrel. The extractor arm is biased out toward the opening of the cavity by a spring-loaded guide which is fitted between the proximal end of the extractor arm and the internal end of the cavity. The extractor arm's elongated section has an indentation extending along one side which is situated over a spring pin, tab or other stop that is fixed within the cavity. The spring pin engages the inner end of the indentation to prevent the extractor arm from being ejected out of the cavity. The outer end of the indentation remains within the cavity when the inner end reaches the stop thereby limiting the extractor arm to its fully extended position. Accordingly, the length of the indentation from the inner end to its outer end is at least the distance of travel of the extractor arm from its contracted position to its extended position and is less than the distance from the spring pin to the opening of the cavity. The thickness of the extractor arm is slightly smaller than the size of the cavity so that when the cartridge is fully seated in the chamber, the extractor arm fits snugly in the cavity but it is not too tight so that binding within the cavity is prevented and the helical coil spring and guide can push the extractor out until the inner end of the indentation reaches the stop.

As particularly shown in FIG. 3, the extractor arm for the rimless extractor assembly has the standard thickness ($t_s$) at its distal end which, as described above, is slightly smaller than the size of the cavity. This snug fit between the distal end and the cavity opening allows the projection on the arm to securely hold the base portion of the shell which extends out from the firing chamber when the cartridge is fully seated in the chamber and the extractor arm is in its contracted position. The intermediate section of the extractor arm, between the distal end of the extractor arm and the outer end of the indentation, has a reduced thickness ($t_r$) which is more narrow than the thickness of the arm at its distal end (i.e., $t_r<t_s$). The reduction in the thickness of the intermediate section can be on both sides of the arm, but is at least provided on the side of the arm that is opposite from the cartridge in the firing chamber which permits the arm and its projection to slightly rotate within the cavity so that the end of the arm 38 is moved away from the chamber and the cartridge as the tapered shell is being inserted and removed from the firing chamber.

The opening to the cavity may have a bevel which helps guide the arm into the cavity and also helps prevent the arm from binding around a sharp corner at the opening, particularly when the narrowed intermediate section has a step reduction in thickness. It will be appreciated that rather than using a step reduction, the arm could be tapered from the standard thickness at a location on the arm proximate to the distal end to the outermost end of the intermediate section which is the location on the arm at the cavity opening when the arm is fully extended so that the inner end of the indentation is at the stop.

The position and orientation of the extractor arm are shown in FIGS. 1A-1C relative to the firing chamber and a tapered shell during the insertion, firing and removal steps. In FIGS. 1A and 1C, the arm is at its fully extended position, and in FIG. 1B, the arm is in its fully contracted position. FIG. 1A shows the shell as it is being initially inserted or withdrawn completely from the firing chamber, and in this position, the longitudinal axis of a tapered shell may have an acute angle relative to the bottom of the chamber's sidewall which is directly in-line with the arm. The shell continues to enter the chamber and the tip of the arm's projection engages the shell's cannelure, and when the shell is withdrawn from the chamber, the cannelure disengages from the tip. In this position, the distal end of the arm is rotated away from the shell so that the tip of the projection which fits into the cannelure can clear the shell casing. It will be appreciated that in this position, the chamber sidewall constrains the shell casing from an acute angle that would have been necessary to clear the tip of the arm's projection if the arm had the standard thickness and could not rotate which would thereby causing an interference between the casing and the tip of the projection. FIG. 1C shows the shell as its cannelure is engaged with the tip of the arm's projection while the arm is in its fully extended position. FIG. 1B shows the shell as its cannelure is engaged with the tip of the arm's projection while the arm is in its fully contracted position.

It will be appreciated that the length of the arm could be increased so that the rotation of the arm away from the casing is not required. Instead, the tip of the arm's projection would engage the cannelure when the shell is rotated at its acute angle so that there is no interference between the casing and the projection's tip. However, this would require an arm that is long enough for its distal end to extend much further past the opening of the cavity than is required by the design of the present invention so that the tip could engage the cannelure while the shell remain in its acute angle, i.e., a length which would span the distance between the opening and the cannelure as shown in FIG. 1A. In such an alternative design, the arm would need to be pushed into the cavity from its fully extended position while the barrel is being closed and before the top of the frame interferes with the distal end of the arm. If a person attempts to close the barrel without pushing the arm into the cavity, the arm could get bent or otherwise damaged, and if a cartridge is in the chamber during this closure, the casing could also damaged and may cause the shell to be lodged in the chamber when it is fully seated which would prevent the spring force of the arm from being able to extract the cartridge and would require additional force applied to the base of the shell and/or the arm's distal end.

Instead of using such a long arm, the present invention uses a much shorter arm which can rotate away from the longitudinal axis of the firing chamber and the shell's casing. The shorter arm is designed such that at its fully extended position, the length of the arm's distal end which extends out from the opening to the cavity is less than the distance between the opening to the firearm's breech plate and/or frame (not shown). With the inventive design, the arm can remain in its fully extended position while the barrel is being closed. The person does not need to begin pushing in the arm before closing the barrel; instead, as the barrel assembly is being closed and the endmost surface of the arm's distal end engages the opposing surface of the frame and/or breech plate at an acute angle so that the opposing surface forces the arm to retract into the cavity against the opposing force of the helical coil spring. As the opposing surface pushes the arm further into the cavity, the arm pushes the shell further into the firing chamber by the engagement between the projection and the cannelure until the shell is fully seated in the chamber, the arm is in its corresponding contracted position and the barrel assembly is locked in place by the engagement between the hook and barrel latch. The endmost surface of the arm's distal end is preferably rounded to provide a tangential engagement between the endmost surface and the opposing surface of the frame and/or breech plate as the barrel assembly is being closed.

As illustrated in the various figures, different caliber barrels can be fitted to the firearm frame. Additionally, various aspects of the present invention are applicable to single barrel firearms and multiple barrel firearms. The barrel assembly is preferably connected to the frame through a takedown pin and is biased to the open position by a spring, such as with a torsion coil spring.

The embodiments were chosen and described to best explain the principles of the invention and its practical application to persons who are skilled in the art. Various modifications could be made to the exemplary embodiments without departing from the scope of the invention, and it is intended that all matter contained herein shall be interpreted as illustrative rather than limiting. Although the embodiments shown herein disclose a barrel which fits an elongated cartridge that is typically used in an assault rifle, barrels that with other cartridges may also be used according to the present invention, such as a .45 colt cartridge. Thus, the breadth and scope of the present invention should not be limited by any of the above-described exemplary embodiments, but should be defined only in accordance with the following claims appended hereto and their equivalents.

What is claimed is:

1. A barrel for a firearm that fires a projectile from a cartridge shell, comprising:

a barrel body extending for a barrel length between a proximal end and a distal end;

a bore extending through the barrel body from the proximal end to the distal end, wherein the bore is comprised of a cartridge chamber section and a rifled section and has a bore diameter, wherein the cartridge shell fits within the cartridge chamber section and the projectile extends from the cartridge chamber section into the rifled section, wherein the cartridge shell with the projectile has a shell length within the bore, wherein the rifled section of the bore is further comprised of a plurality of rifling grooves extending helically through the bore between a plurality of rifling lands, wherein each of the rifling lands has a land width, and wherein the bore has a groove diameter that is greater than a land diameter by an amount that is more than one half of the land width.

2. The barrel of claim 1, wherein each rifling groove has a groove width greater than twice the land width.

3. The barrel of claim 1, wherein the cartridge chamber has a chamber length, and wherein twice the chamber length is within one bore diameter of the barrel length.

4. The barrel of claim 1, wherein the cartridge chamber has a chamber length, and wherein a projectile travel length through the rifled section is shorter than the chamber length.

5. The barrel of claim 1, wherein the distal end of the bore is comprised of a smooth bore section and has a greater diameter than the groove diameter of the rifled section.

6. The barrel of claim 1, wherein the barrel body is further comprised of an extractor assembly, wherein the extractor assembly is comprised of an arm retractably extending from a cavity below the bore, and wherein the arm comprises at least one degree of rotational freedom in the cavity when in an extended position and is constrained from rotation when in a fully retracted position.

7. A barrel for a firearm that fires a projectile from a cartridge shell, comprising:

a barrel body extending for a barrel length between a proximal end and a distal end;

a bore extending through the barrel body from the proximal end to the distal end, wherein the bore is comprised of a cartridge chamber section and a rifled section and has a bore diameter, wherein the cartridge shell fits within the cartridge chamber section and the projectile extends from the cartridge chamber section into the rifled section, wherein the cartridge shell with the projectile has a shell length within the bore, and wherein the barrel length is less than twice the shell length, wherein the rifled section of the bore is further comprised of a plurality of rifling grooves extending helically through the bore between a plurality of rifling lands, wherein each of the rifling lands has a land width, and wherein the bore has a groove diameter that is greater than a land diameter by an amount that is more than one half of the land width.

8. The barrel of claim 7, wherein each rifling groove has a groove width greater than twice the land width.

9. The barrel of claim 7, wherein the cartridge chamber has a chamber length, and wherein twice the chamber length is within one bore diameter of the barrel length.

10. The barrel of claim 7, wherein the cartridge chamber has a chamber length, and wherein a projectile travel length through the rifled section is shorter than the chamber length.

11. The barrel of claim 7, wherein the distal end of the bore is comprised of a smooth bore section and has a greater diameter than the groove diameter of the rifled section.

12. The barrel of claim 7, wherein the barrel body is further comprised of an extractor assembly, wherein the extractor assembly is comprised of an arm retractably extending from a cavity below the bore, and wherein the arm comprises at least one degree of rotational freedom in the cavity when in an extended position and is constrained from rotation when in a fully retracted position.

13. A barrel for a firearm that fires a projectile from a cartridge shell, comprising:

a barrel body extending for a barrel length between a proximal end and a distal end, wherein the barrel body has a body longitudinal axis;

an interior bore extending through the barrel body from the proximal end to the distal end, wherein the interior bore is comprised of a rifled section and a cartridge chamber section and has a bore longitudinal axis aligned with the body longitudinal axis, wherein the cartridge chamber section has a chamber length extending from the proximal end to a chamber end location between the proximal end and the distal end, wherein the cartridge chamber section has a first chamber diameter, wherein the projectile extends from the chamber end location to a projectile end location in the rifled section of the interior bore, wherein a projectile travel length of the interior bore extends from the projectile end location to a muzzle at the distal end, wherein the rifled section of the interior bore has a plurality of rifling grooves with a land diameter and a groove diameter, wherein the projectile travel length is less than the chamber length, wherein the rifling grooves extend helically through the bore between a plurality of rifling lands, wherein each of the rifling lands has a land width, and wherein the groove diameter is greater than the land diameter by an amount that is more than one half of the land width.

14. The barrel of claim 13, wherein the barrel length is approximately equal to double the chamber length.

15. The barrel of claim 13, wherein the cartridge chamber section has a second chamber diameter smaller than the first chamber diameter and a first taper between the second chamber diameter and the first chamber diameter, and wherein the land diameter is smaller than the second diameter.

16. The barrel of claim 15, wherein the first chamber diameter is a minimum diameter of the cartridge chamber section, and wherein the cartridge chamber section further comprises a second taper widening to a maximum diameter proximate to the proximal end.

17. The barrel of claim 16, wherein the first taper is steeper than the second taper.

18. The barrel of claim 13, wherein the distal end of the interior bore is comprised of a smooth bore section and has a greater diameter than the groove diameter of the rifled section.

19. The barrel of claim 13, wherein the barrel body is further comprised of an extractor assembly, wherein the extractor assembly is comprised of an arm retractably extending from a cavity below the interior bore, and wherein the arm comprises at least one degree of rotational freedom in the cavity when in an extended position and is constrained from any substantial rotation when in a fully retracted position.

* * * * *